US005799591A

United States Patent [19]

Anderson

[11] Patent Number: 5,799,591

[45] Date of Patent: Sep. 1, 1998

[54] INCINERATOR FOR MEDICAL WASTE

[76] Inventor: Berris M. Anderson, 330 Gates Ave., Brooklyn, N.Y. 11216

[21] Appl. No.: 800,355

[22] Filed: Feb. 14, 1997

[51] Int. Cl.[6] ..... F23J 15/00

[52] U.S. Cl. ..... 110/215; 110/240; 110/241; 110/259; 110/165 R

[58] Field of Search ..... 110/215, 240, 110/241, 259, 344, 345, 165 R

[56] References Cited

U.S. PATENT DOCUMENTS

| | | | |
|---|---|---|---|
| 3,809,436 | 5/1974 | Ciaffone | 110/259 X |
| 3,879,179 | 4/1975 | Chinnock et al. | 110/165 R X |
| 4,627,365 | 12/1986 | Tseng | 110/215 X |

*Primary Examiner*—Henry A. Bennett
*Assistant Examiner*—Susanne C. Tinker

[57] ABSTRACT

An incinerator for incinerating medical waste in which a self-contained unit including a hopper and a fire chamber are supported on a conveyor mechanism, the fire chamber being provided with an opening and a chute coupling the hopper and the fire chamber for supplying material placed into the hopper to the fire chamber; a scrubber tank is provided which includes a rotatable scrubber, a conveyor conduit and a vacuum pump including a suction mechanism to suck up ash from the fire chamber and convey it through the conveyor conduit to the scrubber tank, a water tank is juxtaposed to the scrubber tank, and the interiors of the water tank and the scrubber tank are coupled together for supplying water to the scrubber tank while the scrubber is rotated for condensing the ash into a slurry which drops to the bottom of the scrubber tank and thereby eliminate the ash content supplied to the scrubber, a pump coupled to the scrubber tank through an extraction conduit for extracting the slurry with the bottom of the scrubber tank and conveying the slurry to a slurry water pipe, a jet spray mechanism is provided including a deluge and a water spray for spraying water into the deluge to supply clean water to the slurry water pipe; and a waste water storage tank coupled to the slurry water pipe including a filter coupled with the slurry water pipe to filter onto additional particles for further recirculation of the water.

16 Claims, 9 Drawing Sheets

226
82
50F
48B
22
22C
202
236A
272
216
200
242
228
24
30
32A
28
32
32C
82
34
12
14
16

INCINERATOR FOR MEDICAL WASTE

BACKGROUND OF THE INVENTION

This invention is concerned with an incinerator. More particularly, the invention is concerned with an apparatus for eliminating infectious medical waste.

The incinerator according to the invention is concerned with the elimination of medical waste materials such as hypodermic plastic needles, plastic medical bottles, bandages, contaminated corrugated or cardboard material, paper napkins, rubber gloves, wood and foam. Other types of waste material can also be incinerated, such as municipal waste.

A feature of the invention is to harness and reduce odor and smoke and prevent the emission of ash, and further the emittants would pose no threat or harm to human health and the environment.

Another feature of the present invention is that the incinerator according to the invention emits only fresh air and or moist mist. Conventional fuel, such as natural, or propane gas, oil, or plasma can be used to heat and incinerate the combustible material.

The incinerator is intended to incinerate materials such as hypodermic plastic needles, plastic medicine bottles, bandages, corrugated cardboard, paper napkins, rubber gloves, wood and foam and municipal waste material.

DETAILED DESCRIPTION OF THE PREFERRED EMBODIMENTS

Figure 1:
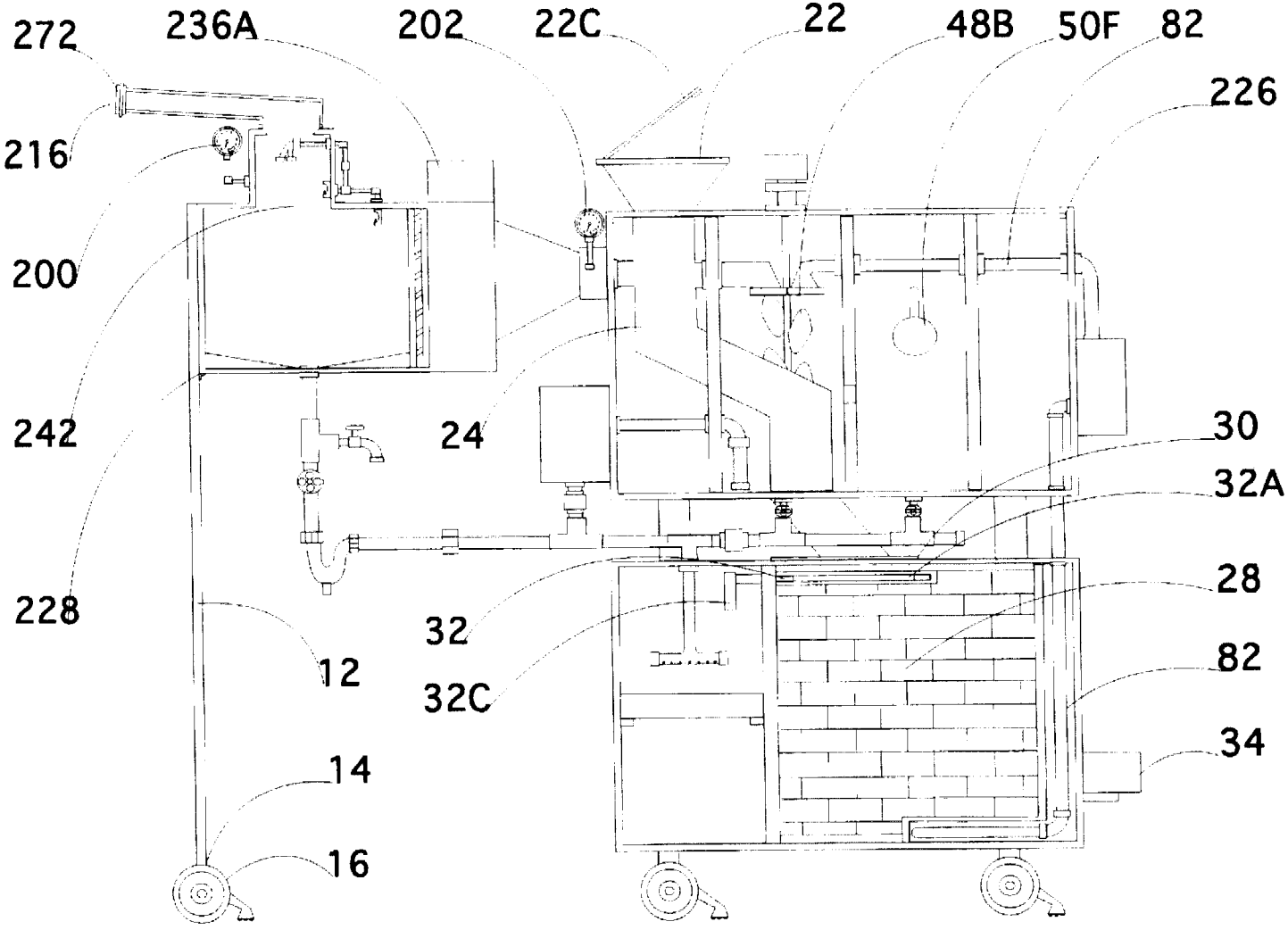
FIG. 1 is a schematic showing of a state A which is a feeding of garbage or refuse into a fire chamber, and in this Figure, garbage is fed into the fire chamber and the damper is open during the process as noted in the drawing.

The detailed description of the drawings which shows the same apparatus 10 in different figures, but with the material in the components during different stages of the system for processing the waste material. Specifically, apparatus 10 includes a self-contained unit which is a portable incinerating system and can be moved from place to place and includes a support stand 12 supported by a member 14 to support a pair of locked wheels 16, schematically shown in a stationary or in use condition with the wheels 16 and additional another set of lockable wheels 18 forming a conveyor mechanism for the transport of the apparatus 10 and locking it in place.

Apparatus 10 comprises a hopper 22 for the receipt of material W, generally garbage or refuse for incineration and is transported through chute 24 in the direction of arrow 26 into fire chamber 28 through open top 30 which can be closed by damper 32 shown in its open condition with opening 32A in FIG. 1. Fire chamber 28 generally comprises a fire box which is provided with a power burner 34, shown in this Figure turned off. The power burner 34 effectively burns or combusts the material W in the fire chamber 28 which was deposited through chute 24 and a power burner is used which has a BTU rate of between 50,000 to 185,000 BTU/hour for natural gas. Hopper 22 includes a cover 22C to close it and prevent the addition of unwanted material.

Figure 2:
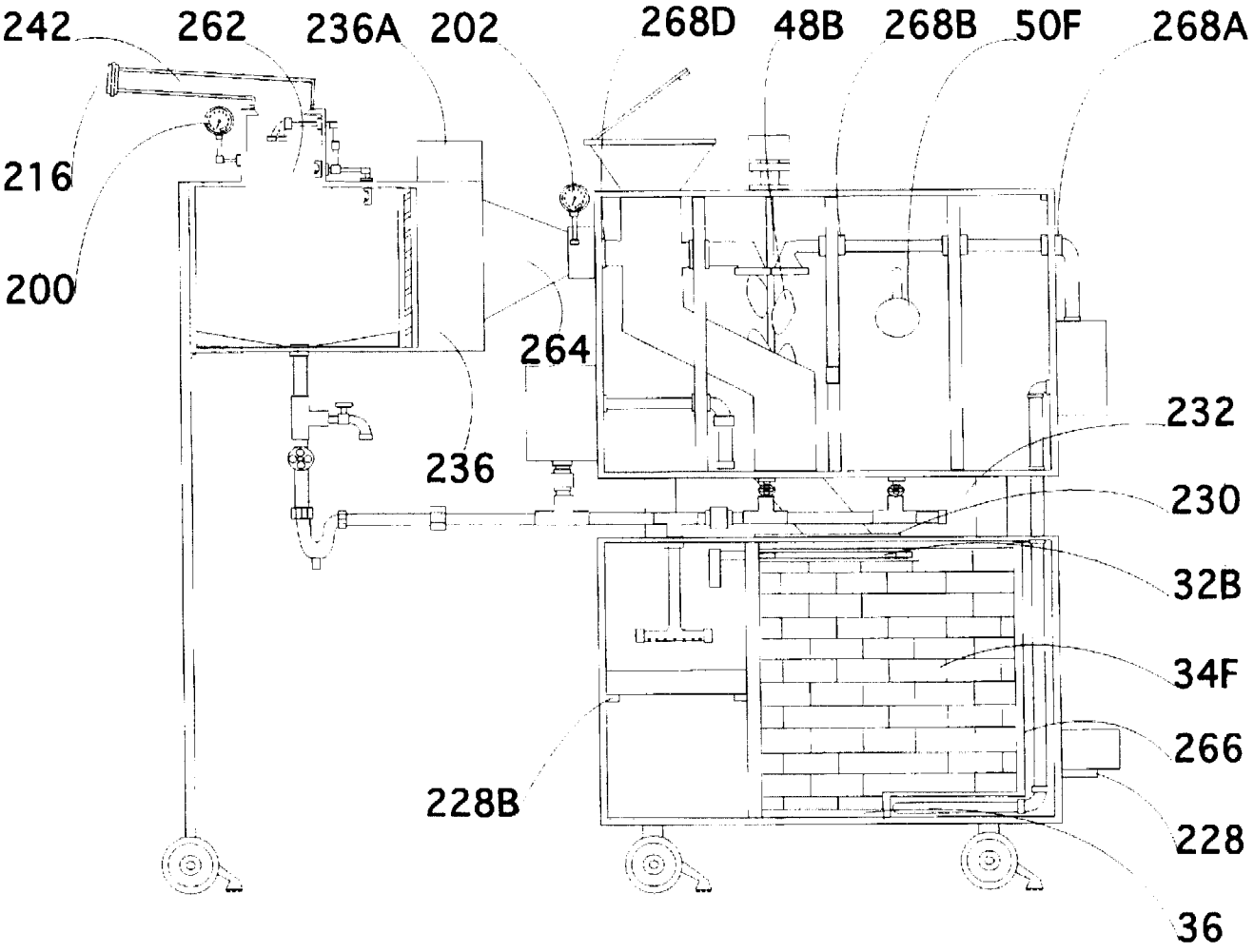
FIG. 2 is a view similar to that of FIG. 1 and shows stage B which takes place after stage A and is a burning of garbage in the fire chamber, and in this figure during incineration of garbage or refuse in the fire chamber, the damper in its closed condition (which has a built-in opening in its closed condition) during operation, but to provide the necessary air for burning or combustion, there is a partial opening of the damper.

In FIG. 2, damper door 32 is closed leaving a small open portion 32A for combustion purposes, and burner 34 is turned on and the refuse material W is incinerated as shown schematically by the flame viewer 34F. The bottom and sides of chamber 28 is provided with a steel plate or plates 36 to assist in the breaking up of any unburned refuse. This is a piece of steel or cast iron which remains on the bottom and sides about three inches up from the base or bottom of chamber 28 to maintain the heat.

Figure 3:
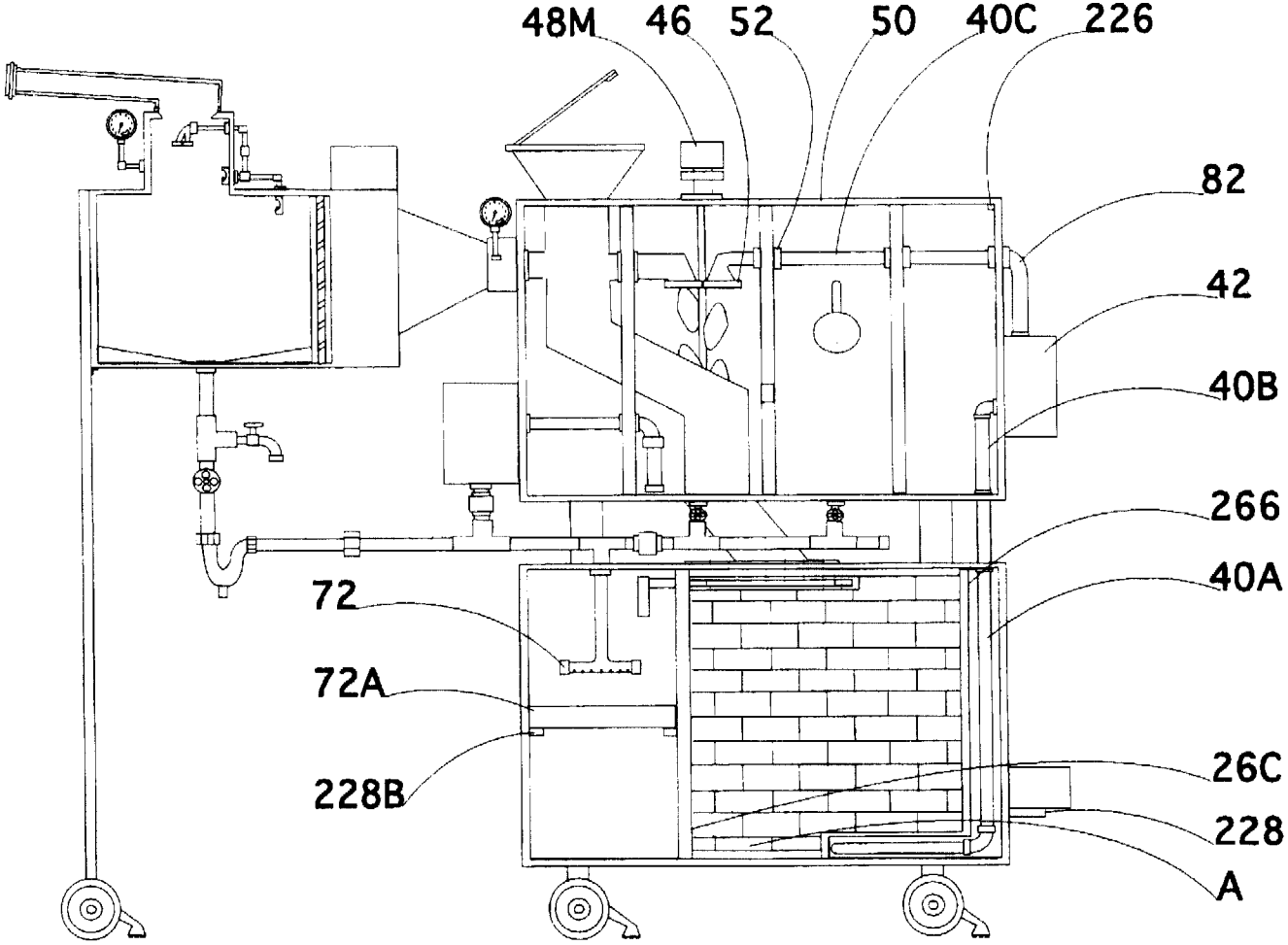
FIG. 3 is another view similar to that of FIG. 1 and shows stage C which takes place after stage B and is concerned with a vacuum extraction of ash refuse to a scrubber and complete combustion takes place.

FIG. 3 shows the refuse material W in the form of ash A after a substantially complete burning. If complete burning is achievable with the material which is to be burned, the steel plate 36 is not necessary. However, since one can never be sure of substantially complete burning, then plate 36 is a preferable item.

After complete burning, ash A is conveyed by means of conveyor conduit 82 in the direction of arrow 40, see arrows 40A, 40B and 40C, by means of a vacuum pump 42 to a scrubber 44 in scrubber tank 44T, as best seen in stage C in FIG. 3. Vacuum pump device 42 includes a suction mechanism to suck up the ash A from the bottom of fire chamber 28 to blow it towards scrubber 44 in scrubber tank 44T through exhaust opening or nozzle 46 from conveyor conduit 82. Scrubber 44 in this Figure, is shown in its stationary condition and includes an agitator 48 generally comprising a motor 48M, agitator blades 48B which are rotated by motor 48M.

Juxtaposed next to scrubber tank 44T is a water tank 50 which is provided with a common wall 52 provided with weep holes as exemplified by reference numeral 52H, desirably four.

Figure 4:
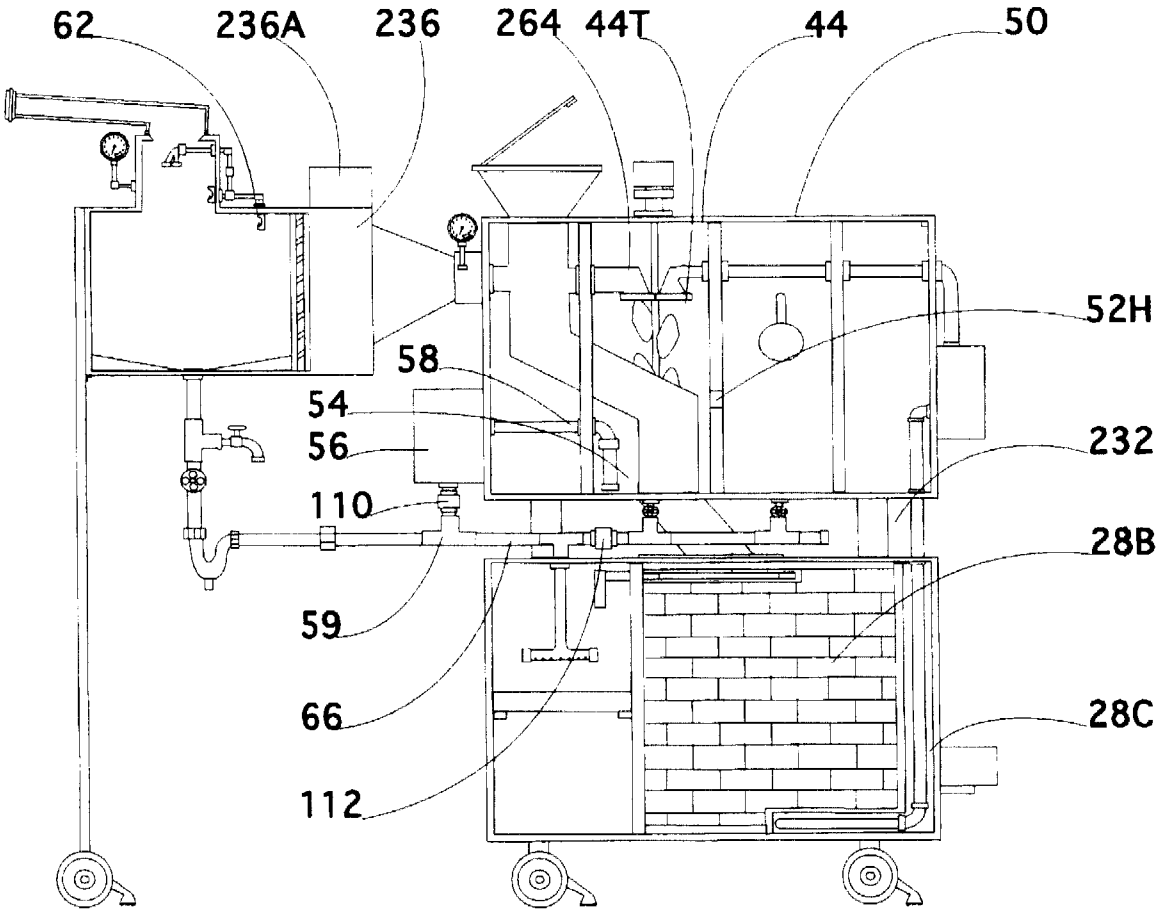
FIG. 4 is another view similar to that of FIG. 1 and shows stage D which takes place after stage C and is concerned with a mixing of ash to slurry in the scrubber.

In FIG. 4, scrubber 44 is shown in its rotating condition and together with the water supplied from water tank 50 condenses the ash into a slurry 54 which then in turn condenses and which eliminates the ash content supplied to the scrubber 44.

Figure 5:
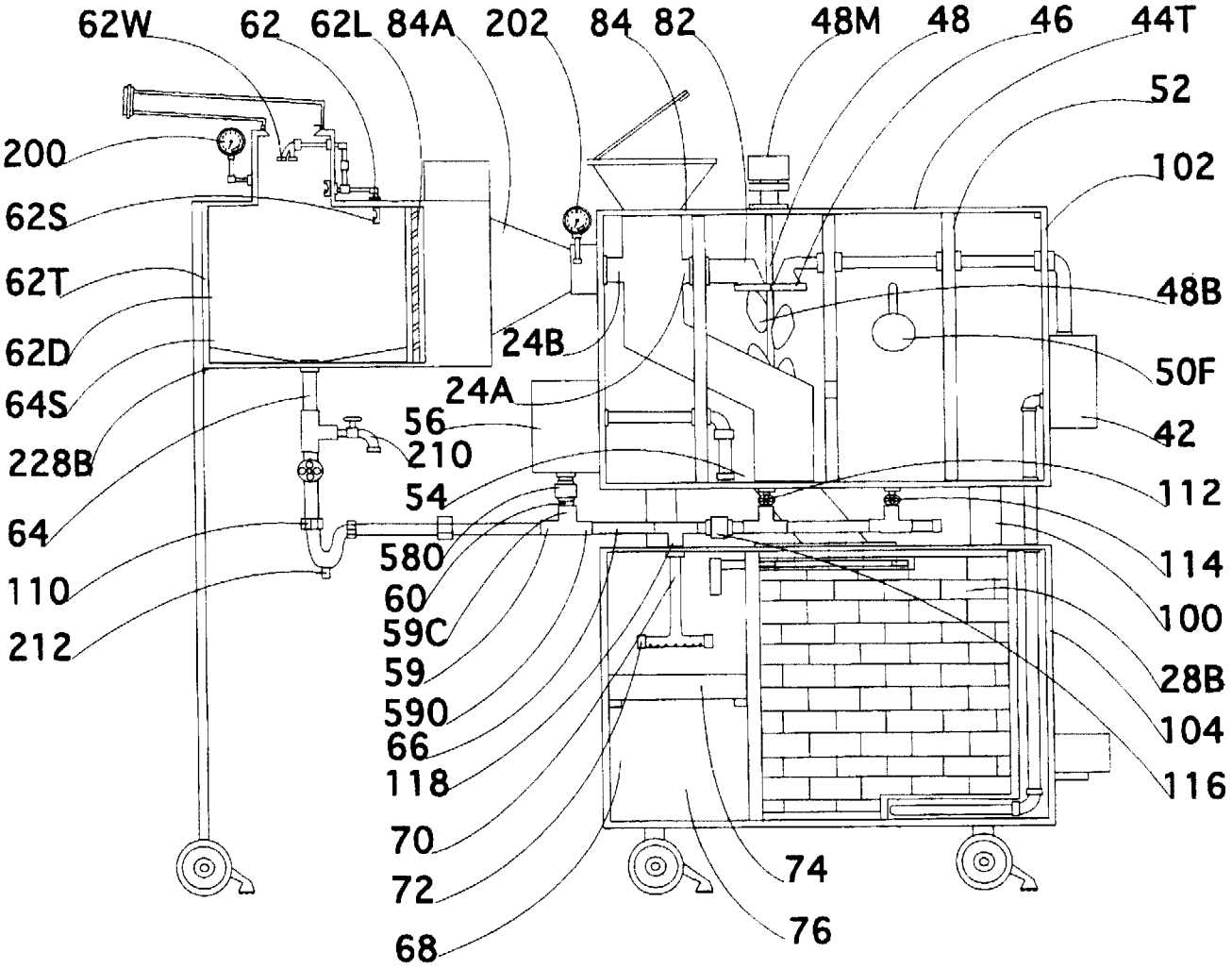
FIG. 5 is another view similar to that of FIG. 1 and shows stage E which takes place after Stage D and is concerned with extraction of slurry to waste water storage, and during the extractions of the slurry from the scrubber by means of suction, cold water fills up the scrubber and immediately traps the odor under the water, and during the entire cycle, after the AC unit removes mercury, dissipating the smoke in the deluge and the heat from the AC and from the fire chamber to sterilize the air before it is released.
Figure 6:
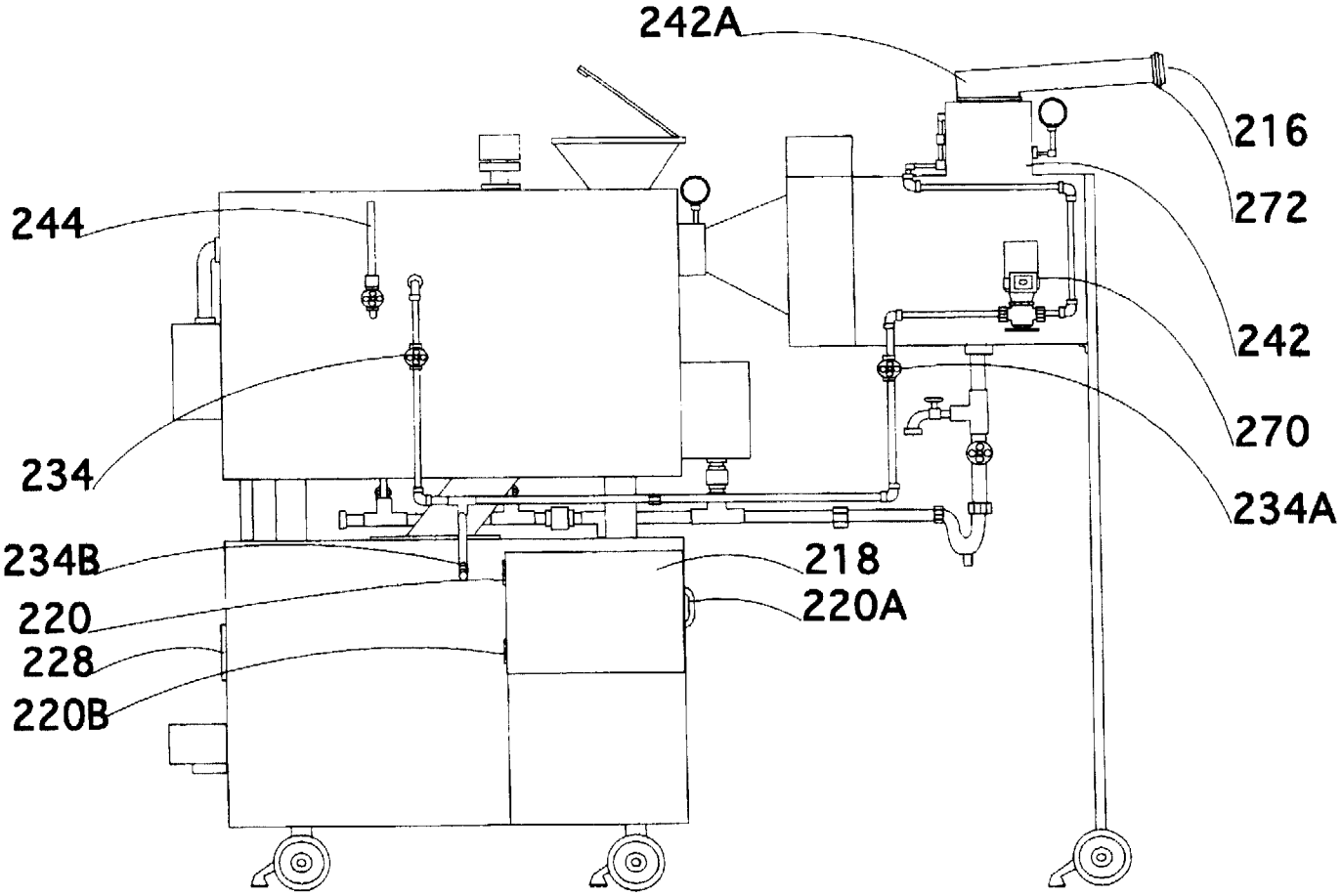
FIG. 6 is a left elevational view.
Figure 7:
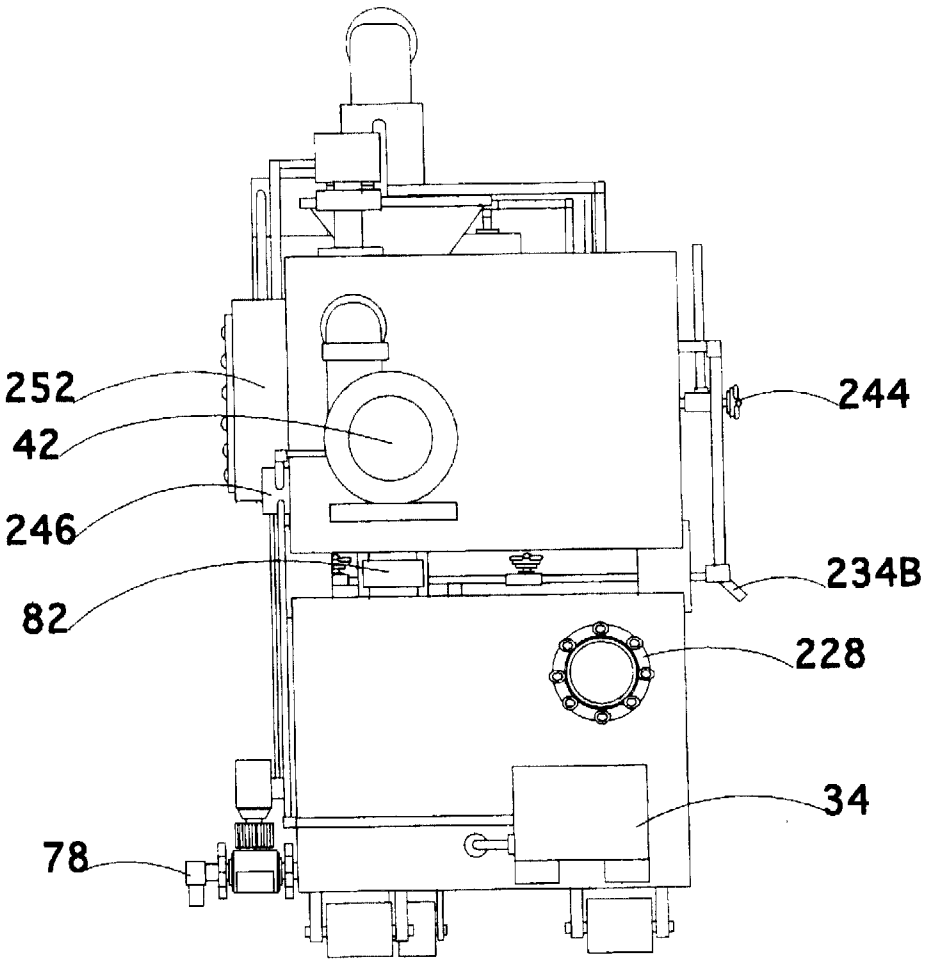
FIG. 7 is a right elevational view.
Figure 8:
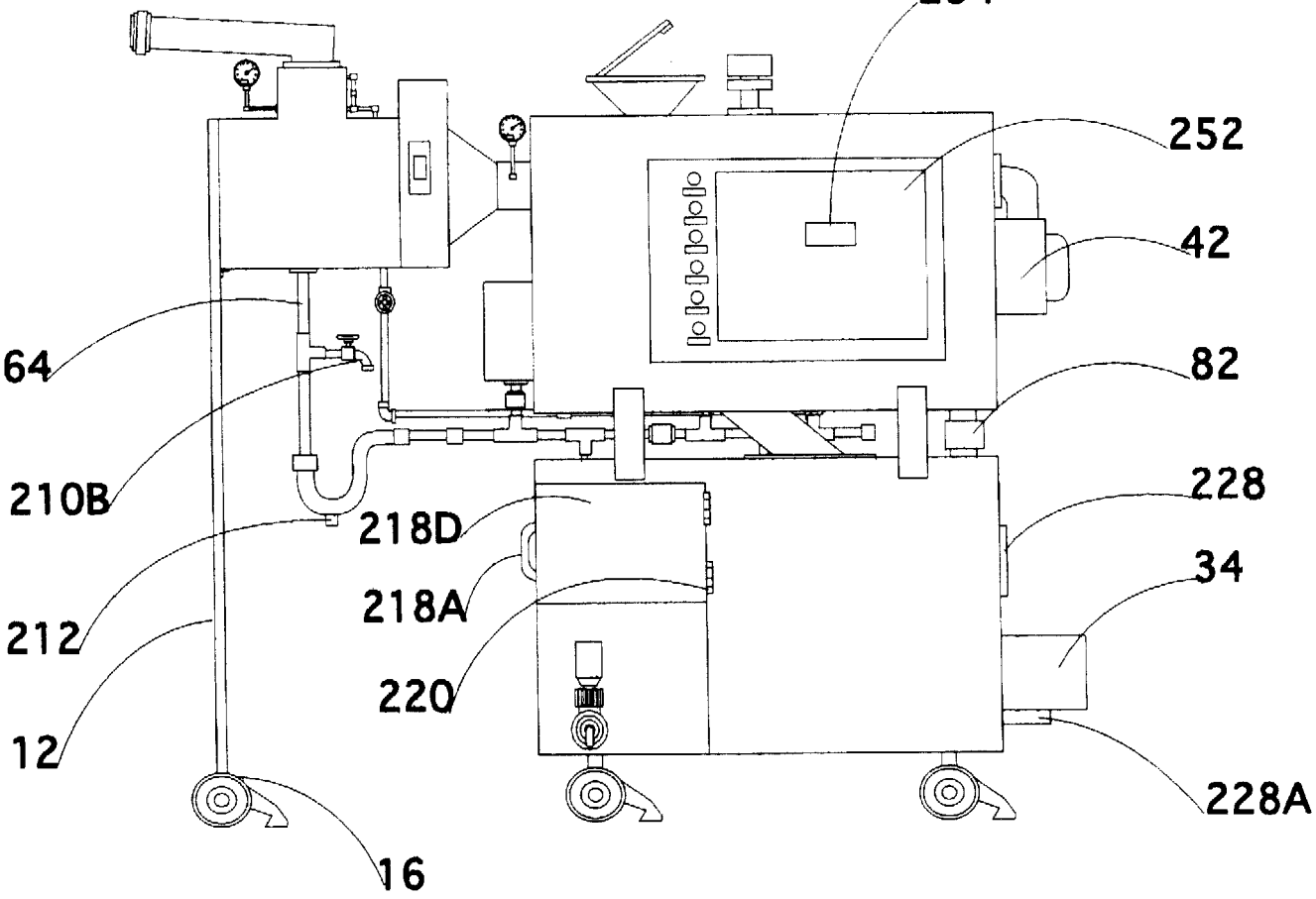
FIG. 8 is a front elevational view.
Figure 9:
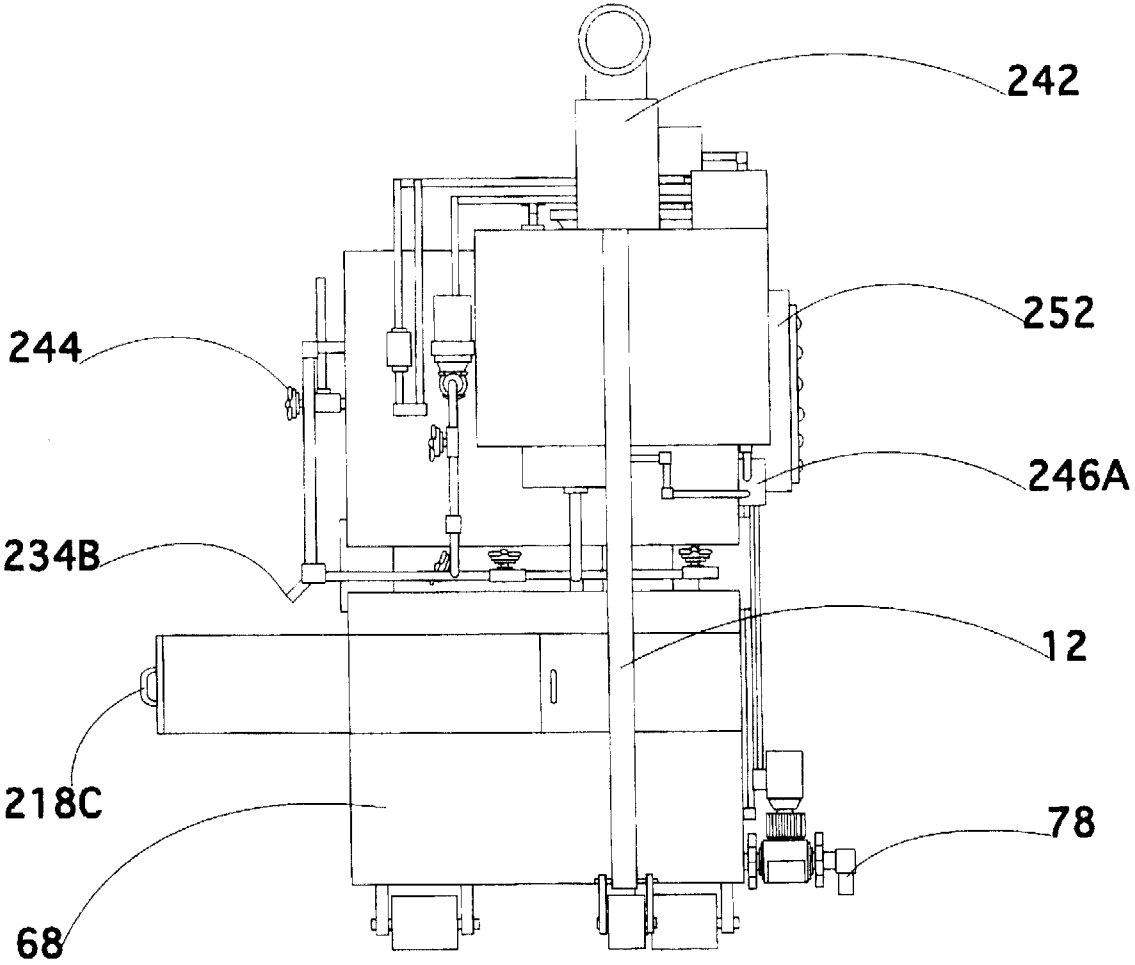
FIG. 9 is a rear elevational view.

In FIG. 5, the slurry 54 is shown at the bottom of scrubber tank 44T, and the slurry is extracted by means of a pump 56, including a motor, through extraction conduit 58 and feeds the slurry into slurry pipe 60, after passing through the motor and pump 56, through outlet conduit 58 into T-connection 59 through center leg 59C and then through leg 59 into slurry-water pipe 66. Outlet conduit 58 is also generally shown as a connector to connect/disconnect pump 56 to/from slurry feed pipe 60 to waste water storage tank 68.

A jet spray mechanism 62 which includes a deluge 62D and a water spray 62W sprays water in deluge 62D which enters into drain pipe 64 into slurry pipe 60 to feed clean water into slurry pipe 60 through leg 59C of T-connection 59, and the clean water from jet drain pipe 64 and the slurry from slurry pipe 60 exiting from Tconnection 59 are combined in slurry/water pipe 66 and goes to waste water or storage tank 68, through another T-connection 18 joining slurry/water pipe 66 and storage tank 68.

The pump 56 withdraws the slurry 54, and it is mixed with the additional water from drain pipe 64 in slurry/water pipe 66. The slurry 54 passes through pump 56 and at T-connection 59, pump 56 is connected with jet spray pipe 64 which supplies fresh water and this is combined with slurry 54 and conveyed in pipe 66 which contains a mixture of fresh water and slurry and is conveyed to waste water storage tank 68 through conduit 70 to a spray head or spray device 72 and is sprayed onto a filter 74 to catch any residue. An outlet 76 is provided at the bottom of water storage tank 68 and is conveyed from outlet 76 through conduit 78 to waste water storage and then can be treated if desired in a separate tank (not shown) and then it is removed and sent to water tank 50. For purposes of this invention, another waste water storage may be provided, not shown, is provided because it is conventional. However, since it is desired to recirculate the water to keep the cost of water down, we propose to avoid another waste water storage which is then discharged. The water tank 50 is part of a water recirculation system and is moved and circulated from tank 50 through weep hole 52H into slurry 54.

A float 50F is provided to maintain the level of the water in water storage tank 50 and close the supply when the level is reached and to have the level above the weep holes 52H. Preferably the water level is maintained so that no more than seventy (70) gallons of water goes in and the water level is below the ash entry pipe 46. Stand 12 holds the jet spray tank 62D high so that the water will fall by gravity into drain pipe 64.

Steam and heat from scrubber tank 44T exit through exhaust conduit 82 through chamber 84 and through entrance opening 24A into chute 24 and out through exit opening 24B and is prevented from exiting from the chute 24 because hopper door or cover 22C is closed, and goes through chute 24 which is aligned with entrance opening 24A and exit opening 24B into air cleaning unit and tank 62D through transition piece 84A connecting chamber 84 to air cleaning unit and tank 62D through louvers 62L. The steam and heat exiting from scrubber tank 44T is in the form of steam and heat.

Vertical water spray 62W and horizontal water spray 62S which are transverse or substantially orthogonal to each other and then water down the exhaust smoke and heat after it passes through louvers 62L, and if by chance there are still some residues, then a further slurry gas is formed at the bottom of tank 62T which together with the water, joins the other slurry 54 through drain pipe 64 to be filtered out and treated by filter 72 in waste water storage tank 68 for further recirculation.

Gauge 200 is an instrument to measure odor. Gauge 202 is a temperature gauge to measure temperature. The gauges are set in accordance with government requirements. A temperature of 1800° F. will satisfy legal environmental requirements, and the entire system and various chambers are intended to withstand a temperature of 4000° F. The 1800° F. is the currently required standard temperature for burning, and the apparatus is built to withstand a temperature up to 4000° F.

The program is responsive to the temperature gauge 202 in order to maintain the unit at a temperature of ( 1800° F. is a recognized U.S. Government standard) and if there is a defect in the whole system or the temperature goes above a preselected temperature, the entire system is shut down.

While the unit is a self-contained unit and can be conveyed from place to place for portability purposes, the unit is constructed in such a manner that it can be easily disassembled as well as assembled.

Since the unit is substantially a closed water circulation unit, there is no need to obtain an additional supply of water, and the water can be reused. If necessary, the water can be changed once a year based on normal usage, but can be changed more often when necessary. Because of the nature of the cleaning which takes place, the water can be dumped into a conventional sewage system, and there is no pollution or damage to the system but no ash is dumped into the sewage system and this is removed and used for example in road construction, or wherever ash is necessary.

When the unit is to be moved, it can be dismantled into three separate component parts, or as noted, heretofore, the unit can be moved on its wheels and moved from place to place and locked place.

For dismantling purpose, the unit is provided with four legs 100 which elevate chamber 102 above chamber 104. Legs 100 include conventional locks, to lock chamber 102 above chamber 104. In a similar manner jet spray mechanism 62 can be disconnected from chambers 102 and 104 by disconnecting connector 580 and connector 110, and check valve connectors 112 and 114 connecting pipe 66 to chamber 102 and check valve 116 and T connector 118 to disconnect chamber 104. A safety drain cock and valve 210 is provided to withdraw water if a problem should arise.

It is noted that there is an air space between upper chamber 102 and lower chamber 104 to assist in the dissipation of heat. It is also possible to add fins and/or use a heat exchanger, if it is necessary to dissipate heat. However, it is possible to use or sell this heat to a leading electric manufacturing company as energy recovery.

A clean out plug 212 and terminal 214 are provided so that appropriate clean out can take place.

When using the system according to the invention, there is no fly ash. In the present invention, all of the fly ash is trapped in the fire combustion chamber 28.

The damper and the hopper door are opened together in order to feed the material into the combustion chamber from the hopper, and then the damper is immediately closed after the material is fed. It is fed through the damper opening or through a separate door. Closing of the hopper door 22C stops the refuse from being fed to the combustion chamber 28.

The chute opening is about 14"×8" when fully opened, having a length of 14 inches, and a width of 8 inches, and when closed there is still a small opening, for example about ½ inch in length and with a width of 8 inches, to provide for an area of approximately 4 square inches to allow air to enter the system and enable combustion. The damper is at the bottom of the chute 24 and the damper 32 partially closes the chute opening in the closed condition of the damper.

Should there be excess gas in the fire chamber, then the fire chamber should be bled. If there is excess gas in the fire chamber it would escape through the ½ inch opening of the damper.

Brick insulation in the form of convention fire brick 28B is provided to provide for a standard fire box.

DESCRIPTION OF OPERATION

The incinerator according to the invention is intended to be installed on non-combustible material flooring 218, and to enter through an opening 216A, 10 feet high, and 3 feet and 6 inches wide, 218B. This working model 10 is constructed with hot rolled steel 36, and desirably sits upon four 8" high caster wheels 18. All six sides are welded steel 36 to withstand explosion. This welded steel 36 will melt down with heat exceeding 4000° F.

At the front of the fire chamber, there is a waste water storage 68 to store and drain off water into the public sewer, according to regulations. The filter is removable and positioned 3" from the top, to strain the mixed ash slurry. Discharge from the waste water pump 56 takes place through ¼" holes 72H bore in the spray device 72 and fed from conduit 70. To avoid splashing, the holes 72H from conduit 70 are important to prevent splashing. Over the waste water storage 68, there is a ¾" angle iron frame 238 going to the opening for the chute 24 on the top internal part of the fire chamber 28.

In the track 238A, the door runs, on the track 238B to close off the flame, and to prevent any flying objects or soot from flying out of the fire chamber 28, and when the damper 32 is closed and a ½ opening 32A is provided to bleed out smoke and excess gas from the fire chamber 28, and to provide a circulation of air 216 in the system.

The waste water storage tank 68 is made of hot rolled steel to withstand a temperature of 800° F. (202), and the doors are swinging doors 218D, made from hot rolled steel to withstand a temperature of 800° F. and are equipped with heavy industrial hinges 218 and heavy industrial handles 218A for opening them.

The handles 32C of the damper 32 are visible over the filter 72 in the waste water storage 68. An outlet 76 is on the outside, and a rust proof 222 and waterproof coating 222A paint is on the inside of the waste water storage.

The fire chamber 28 is constructed to withstand temperatures of up to 4000° F. The internal parts of the fire chamber is six pieces of hot roll steel welded on the outside. The enclosure is lined with a kaowool blanket 28C which provides protection for the steel. Ceramic fire resistant bricks are laid on the six surfaces to prevent melt down and to maintain intensive heat. On the back are four corner blocks 226 for the four corners which are welded on with ¼" threaded nuts 226A and bolts 226B, to hold on the back with an opening for the burner nozzle 34 and flame view glass 228 and bracket 228A for the power burner 34. A fire resistant compound material is used to seal all openings around the door, and around the burner nozzle 34, and lead putty 228B is used to seal the opening. Ducts 82 are laid in one corner of the fire chamber 28 to extract the ash and in the middle of the top an opening for the chute 24 is cut out and a flange 230D with a fire resistant gasket 230A are bolted down firmly, on top of the fire chamber 28, as well as the duct pipe 82 coming up from the fire chamber 28. Four steel legs 100 are screwed on the side of the fire chamber and on a bottom part relate to 102/104 on chamber top of the upper section with an elevated space of 8", which is called the air shaft 232, which helps to cool the system down. The upper compartment is divided into four sections with partition steel plates 36 forming the sections, one is the encloser for the vacuum pump and the duct 82 coming from the fire chamber 28 to the vacuum 42, and from the vacuum 42 to the scrubber 44.

The next section is the cold water tank 50 which holds 35 gallons of cold water, with desirably four weep holes 52H which as based on the size, are preferably ¾ inches, between the water tank 50 and the scrubber tank 44T to feed water into the scrubber tank 44T. The cold water service is provided with shut off valves 234, and are fed into the tank 50 by means of self closing valves and float. Under the water tank in the air shaft passage are lock off valves 112/114 to drain the water from the tank 50. From the vacuum 42, the duct 82 runs above the water in the water tank 50 to the scrubber 44T. The scrubber 44T is constructed for holding water fed from the water tank 50 by means of the weep holes 52H.

The chute 24 that feeds waste to the fire chamber 28 passes through the scrubber and bolted to 230D on top of the fire chamber, using the cold water to cool the system down. The scrubber 44T is also provided with a motor 48M with blades 48B which mixes the Ash from the fire chamber 28 with the water. A waste water pump 56 is connected with a one inch copper pipe 58 welded ¼ from the bottom of the scrubber 44T to pull out the mixed Ash/water combination to the filter 74 over the water storage tank 68. The chute passes through the scrubber tank 44T and goes through the cold water to cool the system down and connect to the flange 230D on top of the fire chamber 28.

At the bottom of the scrubber tank 44T care drain pipes 66 with shut off valves 112/114 to drain and wash the scrubber tank 44T out. From the scrubber tank 44T to the air cleaner 236, ducts 82 are connected to the cross-section and the chute 24.

The next compartment is the passage way for the cross-section which is connected to the hopper 22 or feeder and leading to the air cleaning unit 236, an electrical waste water pump 56 which pulls the mixed Ash/water from the scrubber tank 44T to the filter 74 and waste water storage 68. The top or cover 22 is bolted down to the top of the upper section with four corner blocks 226 with ¼ bolt with a high temperature gasket 230A on the frame and seal to prevent odor or smoke from leaking out. The transition piece 84A that connects the duct to the air cleaning unit 236, and adjacent to the air cleaner 236 is a metal box with a free standing leg 12 or support for the smoke deluge 62D and also the drain pipe for waste water.

A louver 62L provides protection for the air cleaning unit 236 by preventing splashing of water in the electrical ionization system 240. Two atomizer jet sprays 62, for spraying cold water from the louver position 62L to dissipate the smoke and heat 264. At the top of the smoke deluge 62D is the smoke stack 242 with three jet sprays 62, a pair of twin jet perpendicular sprays 62W in the stack and two in the stack 62S and two in the smoke deluge—sprays 62R and 62S are in the deluge. The purpose of the perpendicular sprays are to prevent the exiting of odor and wash away smoke and the heat down the drain, one is a twin head which sprays down cold water to prevent any smoke 264A that may escape or, heat 264B from emitting, only sterilized air and moist mist. The complete dissipating and neutralization of odor and harnessing of smoke. The waste water drains down into the drain pipe which is connected under the waste water pump 56, that leads to the filter 74 over the waste water storage 68.

The complete cycle is approximately 27 minutes, depending on what is being burned in the fire chamber. The air cleaning unit 236 and the smoke deluge 62D are the first units along with the burner 34 to start the cycle first. The burner 34 is set for five minutes and to shut off as a test of the operation, the air cleaning 236 and smoke deluge 62D continues until the entire cycle is completed.

Trash is fed through the feeder door 22 of the hopper down the chute 24 into the fire chamber. Both the hopper 22 and the damper 32 should be tightly closed, but note the damper still has a ½ inch opening. The cold water supply 234 should be open to fill up the cold water tank 50, and in turn fills up the scrubber tank 44, while the water level is shown in the water gauge 244 when both tanks are filled with 35 gallons in each. Both valves 112/114 under the water tank 50 and scrubber tank 44T should remain closed.

All electrical outlets 246 and plugs 246A are to be checked to see that they are in working condition which is a normal and conventional procedure. Check propane gas tank 248 to see that the valve is open. Check fuses 250 in control panel 252, and what program timing either for small or full capacity. Push start button 254 and immediately the start light comes on, then the gas pilot valve 256 warm up, and the transformer 258 heats the electrodes 260 to red hot by viewing the ignition on the electrodes, then the gas valve 256 opens, the gas starts to flow, and the motor fans the flame 34F which is adjusted to a blue flame 34. Then after the fire 34F burns all of the waste material in the fire chamber 28 for five minutes the burner 34 shuts off while the smoke bleeds out through the duct 82 into the tank to the air cleaner 236. Some heat and smoke and odor goes up through the ½" of the damper 32 through the chute 24 to the air cleaner 236, where fresh air 216 is entering from the chimney stack 242 into the system.

In the air cleaning unit 236, an ionization process neutralizes all of the carbon monoxide and releases hot air which goes through the louver 62L, which breaks up the heat and the smoke 264B in columns into the water flood 262 which drives the heat and smoke 264A to the back wall 52, and washes down into the drain 64, and if any smoke 264B escapes into the stack 242 there are three other jet heads 62 preventing any passage while a combination atomizer 62 sprays down water on any escaping smoke.

Then the vacuum 42 extracts out all of the ash out of the fire chamber 28 and blown down into the scrubber tank 44T. When that process is over, the scrubber motor 48M starts and mixes the ash by spinning blades 48B into water, then the water pump 56 energizes and pulls out the mixture by means of a 1" copper pipe 58 installed ¼" from the bottom of the scrubber 44T to the filter over the waste water storage 68. Then as the pump 56 pulls out the mixture of ash and water, the fresh water in the cold water tank 50 flows through the weep holes 52H into the scrubber tank 44T trapping any odor that remains in the scrubber tank 44T, while the intensive heat 264A from the fire chamber 28 kills all bacteria. The water tank 50 also will be refilled to start another cycle. The cold water supply 234 should remain open throughout the 27 minute cycle, until the unit shuts down. A timing programmer can be provided to adjust to septic material to be burned. The complete construction was made rustproof 222 and waterproof 222A before painting. The intensive heat passage area 232 was painted with high intensive heat resistant paint to prevent peeling.

The present invention has produced an inexpensive incinerator system to remove undesirable waste. Any residue that is leftover will be filtered out by the filter and the filter 14 contains ash. The ash that is leftover will stay on top of the filter and above the water and will be removed. This ash can be used to make material for construction purposes such as for road building and back filling.

While there has been shown and described what is considered to be the preferred embodiment of the invention, it will be obvious to those skilled in the art that various changes and modifications may be made therein without departing from the scope of the invention.

What is claimed is:

1. An incinerator for incinerating medical waste, comprising:

a self-contained unit including a hopper and a fire chamber supported on a conveying mechanism; said fire chamber having an opening and a chute coupling said hopper and said fire chamber for supplying material placed into said hopper to said fire chamber;

a scrubber tank including a rotatable scrubber, a conveyor conduit and a vacuum pump including a suction mechanism to suck up ash from said fire chamber and convey it through said conveyor conduit to said scrubber tank;

a water tank juxtaposed to said scrubber tank, and means coupling the interiors of said water tank and said scrubber tank together for supplying water to said scrubber tank while said scrubber is rotated for condensing the ash into a slurry which drops to the bottom of said scrubber tank and thereby eliminates the ash content supplied to the scrubber;

a pump coupled to said scrubber tank through an extraction conduit for extracting the slurry with the bottom of said scrubber tank and conveying the slurry to a slurry water pipe;

a jet spray mechanism including a deluge and a water spray for spraying water into said deluge to supply clean water to said slurry water pipe; and a waste water storage tank coupled to said slurry water pipe including a filter coupled with said slurry water pipe to filter onto additional particles for further recirculation of the water.

2. Apparatus according to claim 1, wherein said fire chamber including a damper associated with said fire chamber for closing off said fire chamber for closing off said fire chamber from said chute and said hopper, power burner for burning the material deposited through said chute into said fire chamber at a temperature of 400° F.

3. Apparatus according to claim 2, including a steel plate to assist in the breaking up of any unburned refuse and to maintain the heat.

4. Apparatus as claimed in claim 1, wherein said scrubber includes agitator blades and a motor coupled thereto for rotation thereof.

5. Apparatus as claimed in claim 1, wherein said means coupling said scrubber tank and said water tank includes weep holes.

6. Apparatus as claimed in claim 1, wherein said water spray includes a horizontal water spray and a vertical water spray, means including louvers coupling said scrubber tank to said jet spray mechanisms for removing an exhaust from said scrubber tank to said jet spray mechanism for removing exhaust smoke containing residues which form an additional slurry and is fed with clean water to said water slurry pipe to be filtered out in said waste water storage tank by said filter for further recirculation.

7. Apparatus as claimed in claim 1, including first and second tanks, said first tank including said fire chamber and said waste water storage tank, said second tank including said scrubber tank and said water tank; and legs joining said first and second tanks to provide for means for disconnecting said first and second tanks from each other for moving, and coupling-decoupling means for connecting said jet spray mechanism to said first and said second tanks for connection thereto and disconnection therefrom, said coupling-decoupling means including disconnecting connector and a connector.

8. Apparatus as claimed in claim 7, wherein said first tank is spaced above said second tank to form an air shaft therebetween for cooling the system.

9. Apparatus as claimed in claim 7, wherein said second tank forms an upper compartment divided into four sections separated by partition steel plates.

10. Apparatus as claimed in claim 1, including ducts laid in one corner of the fire chamber to extract ash.

11. Apparatus as claimed in claim 1, including weep holes between said scrubber tank and said water tank to feed water into said scrubber tank.

12. Apparatus as claimed in claim 1, wherein said chute is connected with said scrubber and fire chamber and using the cold water to cool the system down; the chute runs through the water in the scrubber and connected on the exterior of the fire chamber using the cold water to cool the system down.

13. Apparatus as claimed in claim 12, wherein said chute passes through said scrubber tank and goes through the cold water to cool the system down, because it is connected to the fire chamber where the heat goes up and the intensive heat from the fire chamber, the chute becomes hot and requires cooling.

14. Apparatus as claimed in claim 1, including drain pipes at the bottom of the scrubber tank to drain and wash said scrubber tank out, and shut-off valves for said drain pipes to control draining of said scrubber tank.

15. Apparatus as claimed in claim 1, including an electrical ionization system and a louver associated with said electrical ionization system for preventing splashing of water in the electrical ionization system.

16. Apparatus as claimed in claim 1, including a smoke stack at the top of said smoke deluge, three jet sprays in said stack and two jet sprays in said deluge.

* * * * *